United States Patent [19]

Okumura

[11] 4,207,676

[45] Jun. 17, 1980

[54] CAN OPENER

[75] Inventor: Akio Okumura, Minokamo, Japan

[73] Assignee: Nikko Seiki Company Limited, Gifu, Japan

[21] Appl. No.: 932,121

[22] Filed: Aug. 9, 1978

[30] Foreign Application Priority Data

Feb. 3, 1978 [JP] Japan ..... 53-12763[U]
May 19, 1978 [JP] Japan ..... 53-60397

[51] Int. Cl.[2] ..... B67B 7/38
[52] U.S. Cl. ..... 30/419; 30/424
[58] Field of Search ..... 30/419–427; 310/86, 87, 172, 174

[56] References Cited

U.S. PATENT DOCUMENTS

| | | | |
|---|---|---|---|
| 1,233,569 | 7/1917 | Graemiger | 310/86 |
| 2,257,549 | 9/1941 | Froelich | 30/422 |
| 2,931,307 | 4/1960 | Smith | 310/86 X |
| 2,994,953 | 8/1961 | Aberer | 30/424 X |
| 3,146,555 | 9/1964 | Posener | 30/424 X |
| 3,254,406 | 6/1966 | Hubrich | 30/424 X |
| 3,333,544 | 8/1967 | Turk | 310/86 X |
| 3,798,764 | 3/1974 | Yamamoto | 30/421 X |
| 4,053,981 | 10/1977 | Aberer | 30/426 X |

OTHER PUBLICATIONS

*Standard Handbook for Electrical Engineers,* (9th Ed.), A. E. Knowlton, McGraw-Hill, Sections 9–434, 4–476, 8–95.

*Primary Examiner*—Gary L. Smith
*Attorney, Agent, or Firm*—George B. Oujevolk

[57] ABSTRACT

The present invention relates to a can opener comprising a cutter moved in the vertical direction by an operation lever and a feed gear mechanism disposed below the cutter, in which by the co-operative action of the cutter and the feed gear mechanism, a lid of a can is cut off while the can is rotated. The cutter is rotatably attached to the front face of a movable member having an engaging portion on the lower end thereof, and a regulating member is disposed in the rear of the feed gear mechanism. When the cutter is brought down together with the movable member by the operation lever to cause the cutter to bite into the can lid, the engaging portion of the movable member is engaged with the regulating member.

8 Claims, 16 Drawing Figures

7
6
82
84
83
85
81
86
104
103
16
44
45
38
100
30
67
68
34
33
32
31
35
40
69
70
41
42
43
49
48
46
47
1

CAN OPENER

FIELD OF THE INVENTION

The present invention relates to a can opener. More particularly, the invention relates to a can opener provided with a mechanism for preventing torsion of a cutter.

OBJECTS OF THE INVENTION

It is a primary object of the present invention to provide a can opener in which torsion of the lower end of a cutter in a direction separating from a feed gear is prevented when the cutter is caused to bite into a can lid, whereby falling-out of a can edge from the feed gear can be assuredly prevented.

Another object of the present invention is to provide a can opener in which a cutter is vertically brought down when the cutter is caused to bite into a can lid, whereby this biting operation can be performed very smoothly.

Still another object of the present invention is to provide a can opener in which torsion of a cutter can be assuredly prevented by a simple mechanism when the cutter is caused to bite into a can lid.

A further object of the present invention is to provide a can opener in which a cutter can be dismounted together with a movable member from an operation lever.

A still further object of the present invention is to provide a can opener in which a cutter can be taken out from an operation lever by a simple mechanism and falling-out of the cutter from the operation lever can be assuredly prevented in the state where the cutter is attached to the operation lever.

A still further object of the present invention is to provide a can opener in which an operation lever and a shaft of a feed gear can be tightly supported by a reinforcing plate attached to a case.

A still further object of the present invention is to provide a can opener in which an electric leakage can be prevented easily and assuredly in a shading coil type single-phase induction motor for rotating and driving a feed gear.

A still further object of the present invention is to provide a can opener in which when a cutter is once caused to bite in a can lid by pressing down an operation lever at the can opening step, the can opening operation can be conducted even if the operation lever is not maintained in the pressed state.

A still further object of the present invention is to provide a can opener in which a can being rotated during the can opening operation can be stably supported.

Other objects will be apparent from embodiments described hereinafter and be clearly set forth in the appended claims. Various advantages not mentioned herein will be apparent to those skilled in the art when the present invention is practised.

DETAILED DESCRIPTION OF THE PREFERRED EMBODIMENTS

One embodiment of the automatic can opener according to the present invention will now be described in detail by reference to FIGS. 1 to 9.

Figure 3:
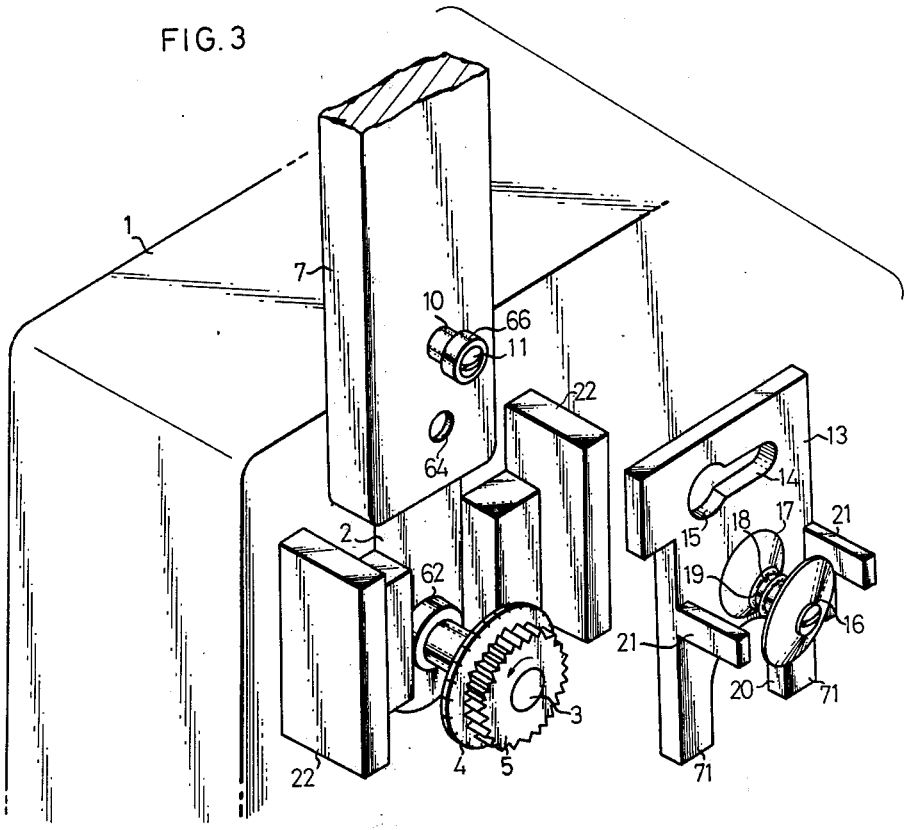
FIG. 3 is an enlarged perspective view illustrating the state where a movable plate is separated from an operation lever.
Figure 5:
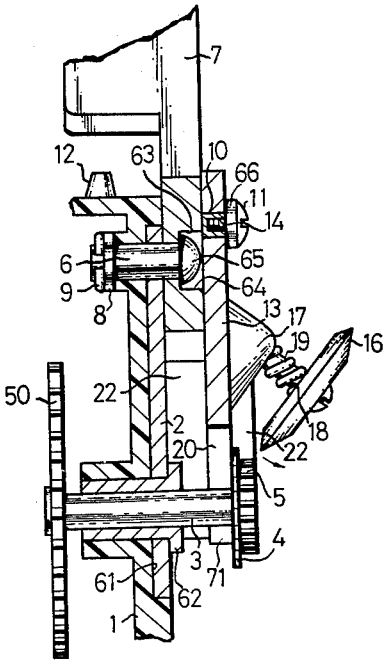
FIG. 5 is a sectional view showing the supporting state of a shaft of the operation lever and an output shaft.

In the drawing, reference numeral 1 represents a case having a motor and a reduction gear built therein. A concave fitting portion 61 as shown in FIG. 5 is formed on the upper portion of the front of the case 1, and a reinforcing plate 2 composed of stainless steel or iron is fitted and fixed to the fitting portion 61 of the case 1 as shown in FIGS. 3 and 5. An output shaft 3 of the above-mentioned reduction gear is supported on the reinforcing plate 2 in the lower portion thereof through a bearing 62. A disc-like regulating plate 4 is fixed to the output shaft 3 and feed teeth 5 resembling teeth of a circular saw are arranged and fixed onto the outer end of the output shaft 3.

A shaft 6 is supported by the case 1 and reinforcing plate 2 above the output shaft 3 off to the left, and the shaft 6 is integrated with the output shaft 3 by the reinforcing plate 2.

An operation lever 7 is rotatably mounted on the shaft 6, and a hole 64 having a step portion 63 as shown in FIG. 5 is formed through the operation lever 7. The head 65 of the shaft 6 is located in the step portion 63 and a stop spring 9 is fitted to the other end of the shaft 6 through a washer 8 to support the lever 7. An engaging pin 10 projects out of the lever 7 and a screw 11 is attached to the outer end of the pin 10 to attach a flange 66.

Figures 1, 2, 15:
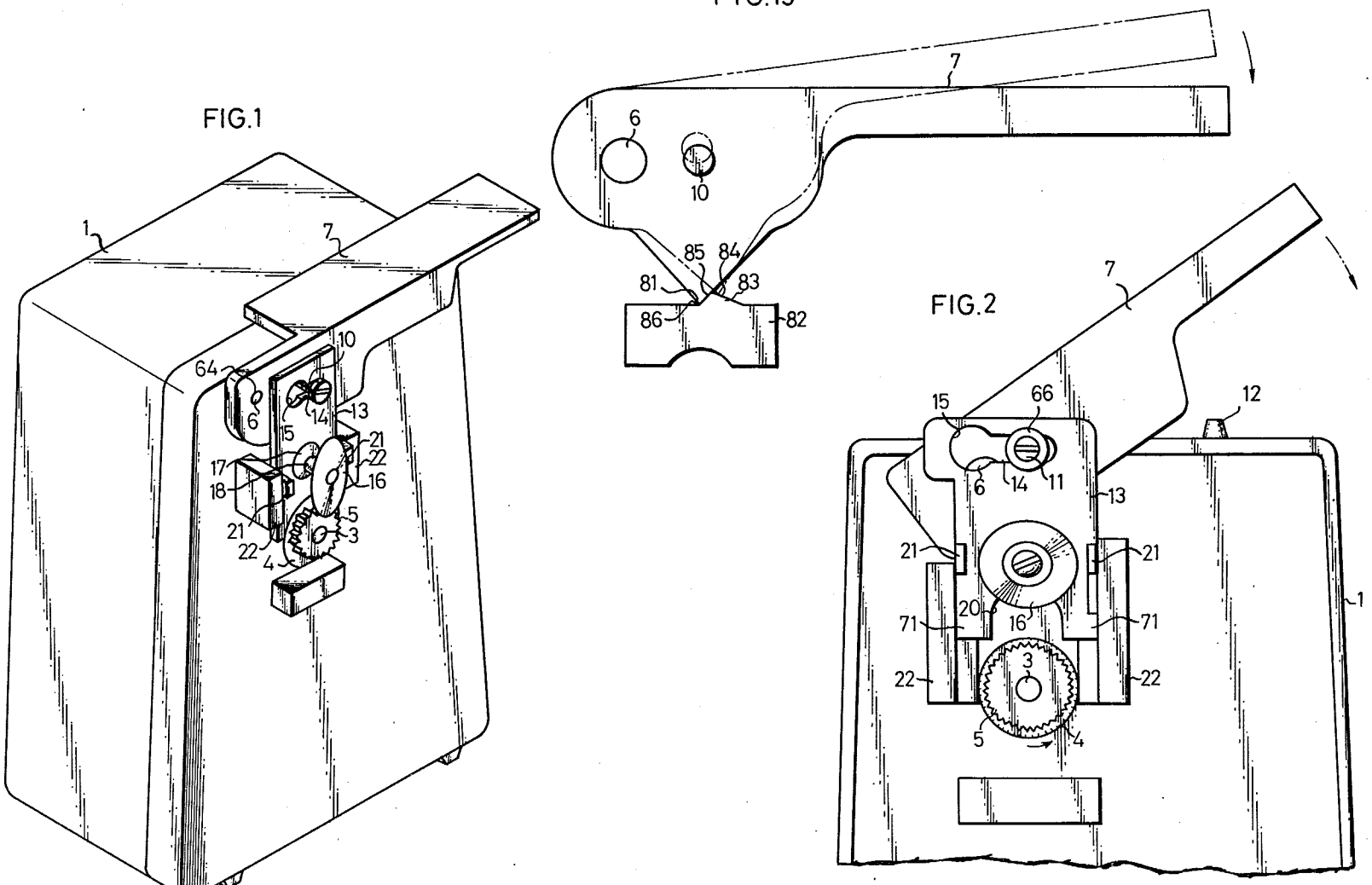
FIG. 1 is a perspective view of a can opener according to one enbodiment of the present invention.
FIG. 2 is a partially enlarged front view of the can opener shown in FIG. 1.
FIGS. 14 and 15 are diagrams illustrating the relative movement between the operation lever and engaging member shown in FIG. 13.

As shown in FIG. 2, a push-button switch 12 is mounted on the top face of the case on the right side thereof. When the operation lever 7 is brought down, the lower face of the lever 7 depresses the switch 12 to start a motor and rotate the feed teeth 5. A movable plate 13 has in the upper portion thereof a long hole 14 to be engaged with the engaging pin 10 projected from the lever 7, and when the lever 7 is rotated, the engaging pin 10 is allowed to slide in the long hole 14 to move the movable plate 13 in the vertical direction. On the left side of the long hole 14, a large diameter portion 15 contiguous to the long hole 14 is formed so that it can pierce through the flange 66 of the engaging pin 10.

As shown in FIGS. 2, 3 and 5, a cutter 16 is rotatably supported on the top end of a shaft 18 attached to a cutter attaching seat 17 formed almost at the center of the movable plate 13 in the obliquely expanded form, and the cutter 16 is always urged toward the end of the shaft 18 by a spring 19 mounted on the shaft 18. When the blade face on the lower end of the cutter 16 is brought down, the cutter 16 bites into a can lid co-operatively with feed teeth 5. A notch 20 of a reverse U-shape is formed at the center of the lower portion of the movable plate 13 so that when the movable plate 13 is brought down, the plate 13 does not fall in contact with the feed teeth 5 or regulating plate 4 located below. A pair of engaging portions 71 are formed on the lower end of the movable plate 13 that defines both the side portions of the notch 20 and they have sliding contact with the back face of the regulating plate 4. A pair of can pressing members 21 are formed on both the sides of the central portion of the movable plate 13 so that at the can opening operation, they press the periphery of the top edge of the can from above to support the can stably.

As clearly illustrated in FIG. 3, a guide member 22 is mounted on the front face of the case 1 so that both the side faces and back face of the movable plate 13 can slide and the cutter 16 of the movable plate 13 moving in the vertical direction can perform the can opening operation assuredly at a predetermined position.

Figure 7:
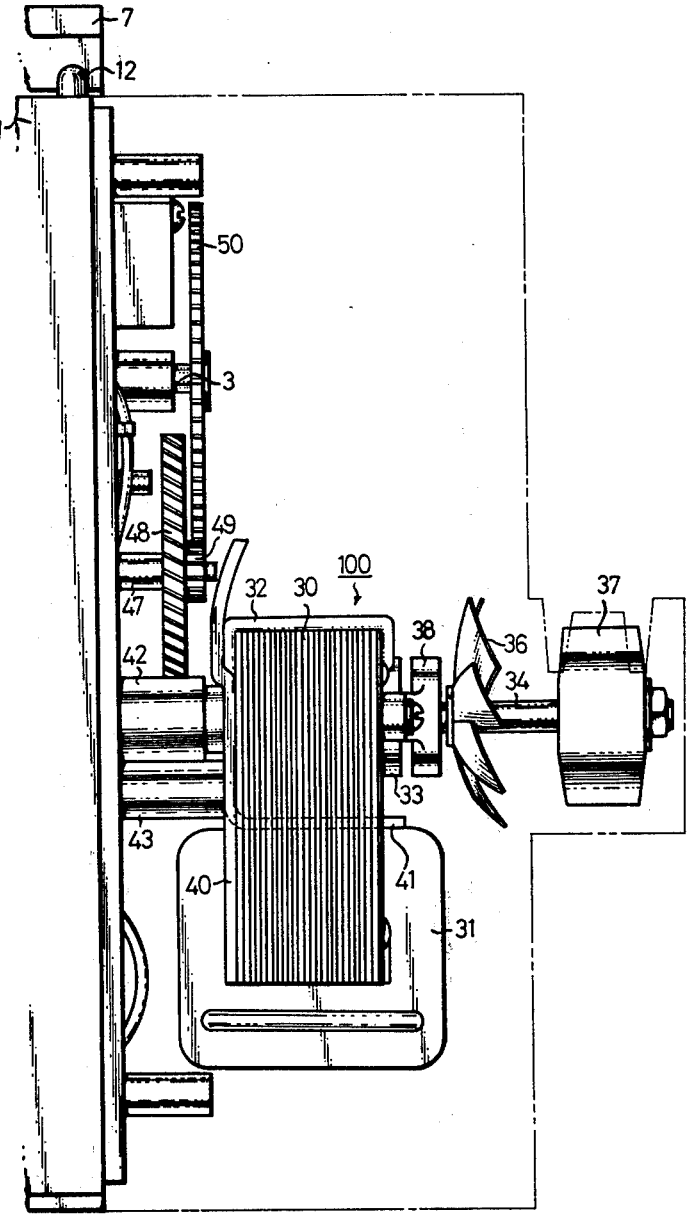
FIG. 7 is a side view illustrating a driving mechanism for the can opener.
Figure 8:
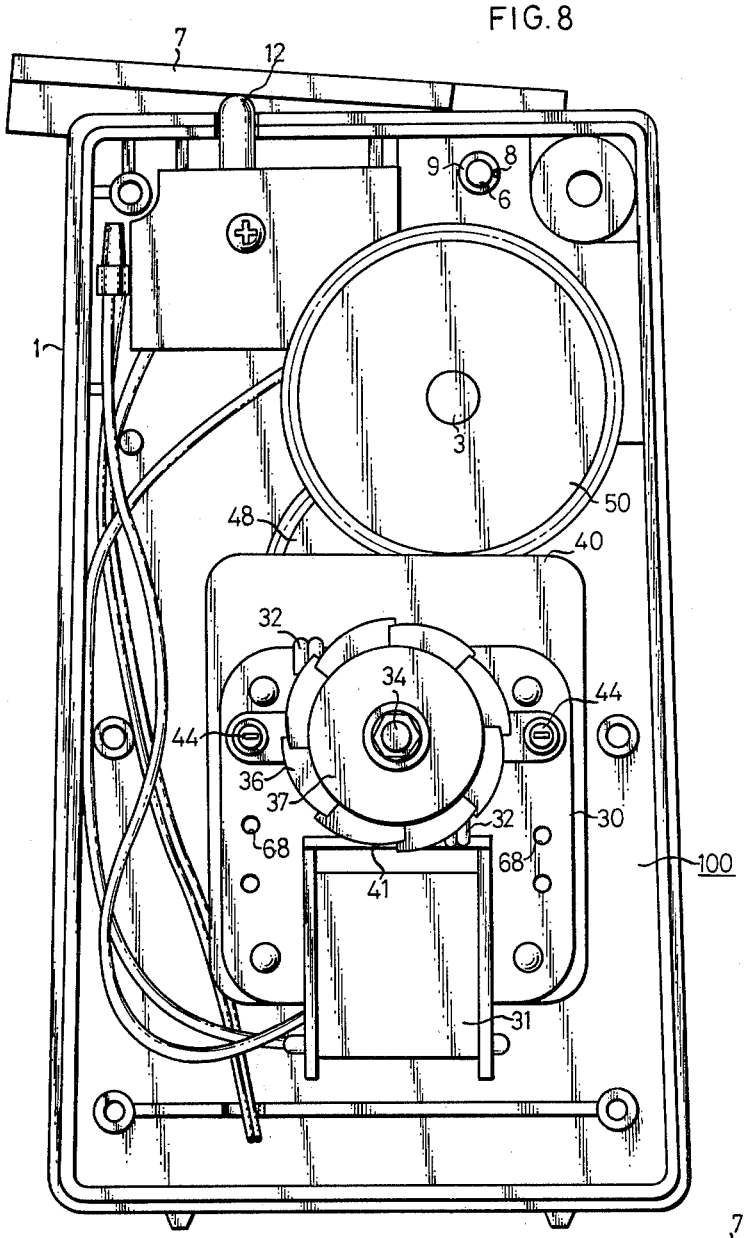
FIG. 8 is a back view illustrating the driving mechanism shown in FIG. 7.
Figures 9, 13:
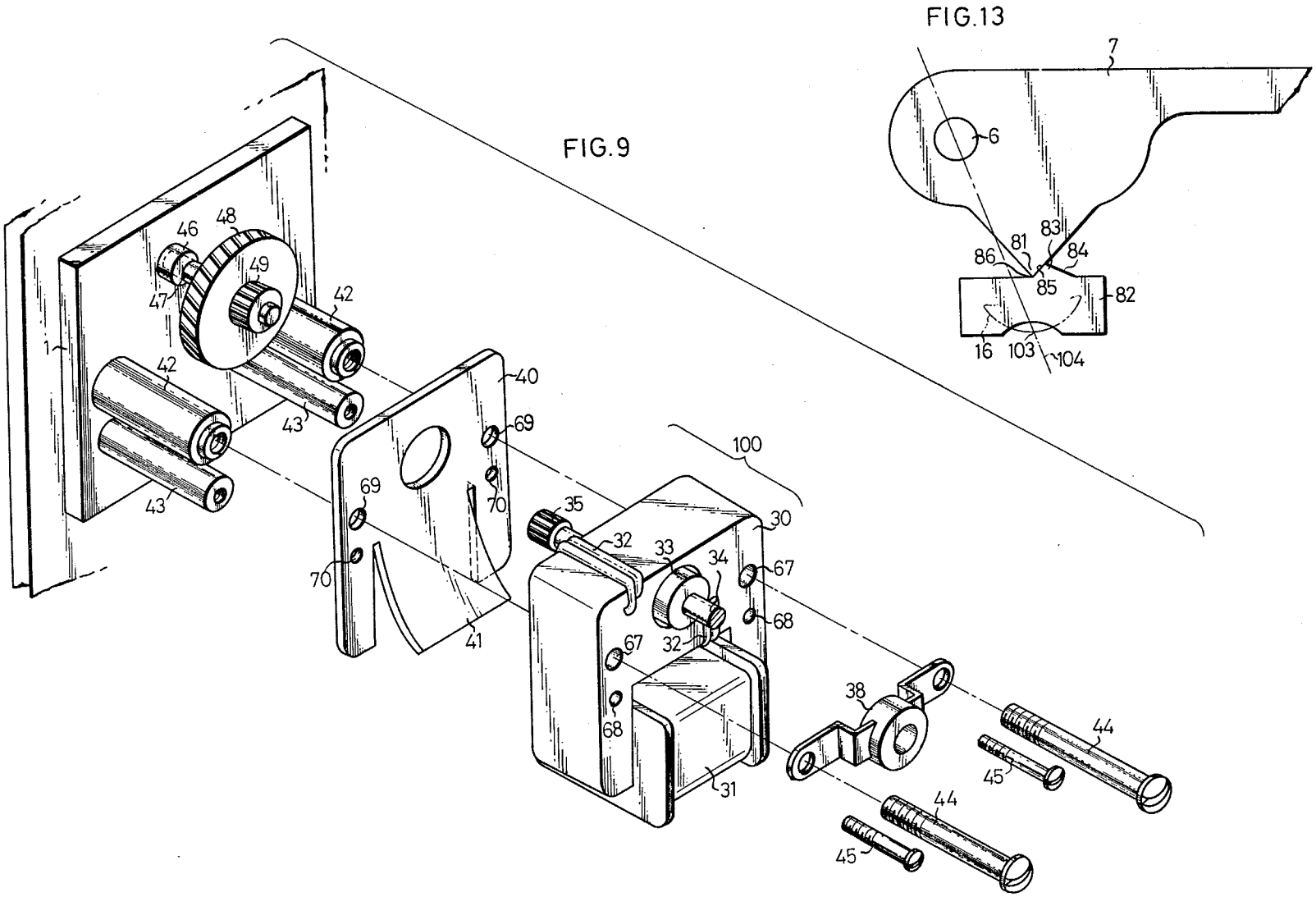
FIG. 9 is a fragmentary perspective view illustrating the attachment state of a shading coil type single-phase induction motor.
FIG. 13 is a diagram illustrating the engaging relation between a push-down projection of the operation lever shown in FIG. 10 and an engaging projection of an engaging member.

A driving mechanism for rotating a can and accomplishing the can opening operation in the above-mentioned structure will now be described by reference to FIGS. 7 to 9.

A shading coil type single-phase induction motor 100 (hereinafter referred to as "motor") is driven when the push-button switch 12 is depressed. A single-phase winding 31 is disposed in the lower portion of a stator 30 of the motor 100, and a shading coil 32 is wound on the upper portion of the stator 30. A small gear 35 (see FIG. 9) is fixed to the left side end portion of a driving shaft 34 of a rotor 33 of the motor 100. On the right side of the rotor 33, a cooling fan 36 is fixed and a grinding stone 37 acting also as a flywheel is fixed to the end portion of the rotor 33. A bearing 38 is disposed to support the driving shaft 34.

A fish paper 40 is disposed to cover entirely the left side face of the stator 30 of the motor 100 and the fish paper 40 is composed of a heat-resistant layer and an insulating layer and is arranged so that the heat-resistant layer falls in contact with the side face of the stator 30. As shown in FIG. 9, both the sides of the lower end of the fish paper 40 are notched to form a tongue piece 41, and this tongue piece 41 is bent and inserted into the stator 30 as indicated by a broken line in FIG. 7 and as shown in FIG. 8 to cover the top face of the single-phase winding 31. Accordingly, the single-phase winding 31 and the shading coil 32 are insulated from each other and also from other metallic members.

A pair of supports 42 and 43 are mounted integrally with the case 1 to support the motor 100. As shown in FIG. 9, a pair of screws 44 and 45 are fixed through holes 67 and 68 of the stator 30 and holes 69 and 70 of the fish paper 40 to fix the motor 100 and fish paper 40. A bearing 46 is formed integrally with the case 1 to support a shaft 47 rotatably. Small and large gears 48 and 49 are attached to the shaft 47, and the large gear 48 is engaged with a small gear 35 fixed to the driving shaft 34 of the motor 100 and the small gear 49 is engaged with a large gear 50 fixed to the other end of the output shaft 3 having the feed teeth 5 fixed to one end thereof. The rotation speed of the motor 100 is reduced by these gears 48, 49 and 50 to transmit an appropriate rotation speed to the feed teeth 5.

In the state shown in FIG. 2, the feed teeth 5 are set on the edge of a can. Then, the top end of the lever 7 is pressed down. At this point, the engaging pin 10 is rotated with the shaft 6 being as the center of the rotation and simultaneously, the pin 10 brings down the movable plate 13 along the guide members 22 while it is sliding in the long hole 14 to the right in FIG. 2. Accordingly, the cutter 16 is caused to bite into a can lid by the pressing force of the operation lever 7. Simultaneously, the push-button switch 12 is depressed and put on by the rotation of the operation lever 7 to drive the motor 100 and turn the feed teeth 5 in the direction indicated by an arrow through the gears 48, 49 and 50 of the reduction gear system and the output shaft 3. Accordingly, the can into which the cutter 16 bites is rotated and the can lid is cut in. When the can is caused to make one rotation by means of the feed teeth 5, cutting of the can lid is completed. In this operation, when the operation lever 7 is pressed down and the cutter 16 is caused to bite in the can lid, an upward force is imposed on the shaft 6 of the lever 7, while a downward force is imposed on the output shaft 3 having the feed teeth 5 fixed thereon by the biting operation of the cutter 16. As a result, they are going to bend, but these forces are supported by the reinforcing plate 2 and bending is prevented. Accordingly, damage of the case 1 or falling-out of the can be such bending can be effectively prevented.

If the top end of the lever 7 is then rotated upwardly, the engaging pin 10 moves the movable plate 13 upwardly according to the procedures reverse to those described above, and holding of the can by the feed teeth 5 and cutter 6 is released. At this point, the push-button switch 12 is released from the lever 7 and is put off to stop the motor 100 and also stop the rotation of the feed teeth 5. Thus, the can opener is ready for the subsequent can opening operation.

The method of attaching and dismounting the movable plate 13 to and from the operation lever 7 will now be described.

In the state shown in FIG. 2, if the top end of the operation lever 7 is turned upwardly, the engaging pin 10 is turned upwardly with the shaft 6 being as the center, and it also slides in the long hole 14 to the left to push up the movable plate 13. When the lever 7 is turned to the position of an erect posture, the engaging pin 10 is shifted from the long hole 14 into the large diameter portion 15. Simultaneously, the lower end of the movable plate 13 is moved upwardly over the feed teeth 5. At this point, if the movable plate 13 is taken out forwardly, it can be dismounted as shown in FIG. 3.

When the movable plate 13 kept in the state shown in FIG. 3 is attached to the operation lever 7, the attachment state shown in FIG. 2 can be attained according to the procedures reverse to those described above. Accordingly, it is possible to take out the movable plate 13 having the dirty cutter 16 and clean it with ease. Therefore, the cutter 16 can always be kept clean and a good sanitary state can be maintained. Further, even during the can opening operation, since the flange 66 of the engaging pin 10 sliding in the long hole 14 is engaged with the engaging face of the movable plate 13, the movable plate 13 is prevented from falling out and is allowed to move along the guide member 22 in the vertical direction. Furthermore, since the shaft 6 of the lever 7 and the output shaft 3 are integrated with each other by the reinforcing plate 2, when the shafts 3 and 6 perform the operation of cutting the can lid, they are prevented from bending. Therefore, the can opening operation can be accomplished assuredly.

In the above-mentioned embodiment, since the motor 100 is attached to the case 1 through the fish paper 40 acting as an insulating member, leakage of electricity from the shading coil 32 to the adjacent driving members can be prevented assuredly. Further, since the top face of the single-phase winding 31 mounted around the stator 30 is covered with the tongue piece 41 formed by notching both the sides of the lower portion of the fish paper 40, the winding 31 can be insulated from the shading coil 32. Accordingly, the driving of the motor 100 is not disturbed at all and the motor 100 can be operated assuredly with safety.

Furthermore, the fish paper 40 can easily be attached together with the motor 100 by means of screws 44 and 45, and therefore, the assembling operation can be remarkably facilitated. Since the fish paper 40 is composed of an insulating layer and a heat-resistant layer, it is prevented from being thermally damaged by the heat generated by the motor 100, and therefore, an everlasting insulating effect can be attained.

Figure 4:
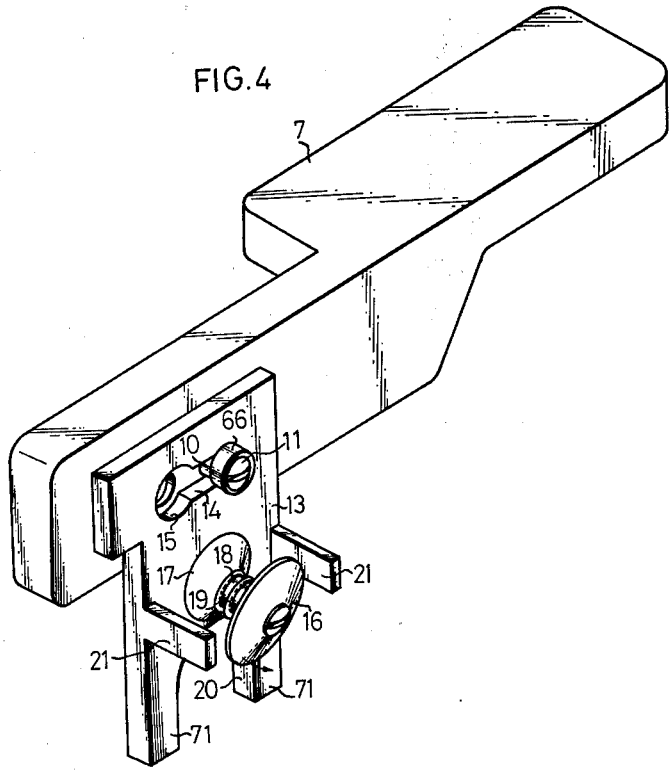
FIG. 4 is an enlarged perspective view showing the state where the movable plate is attached to the operation lever.

In the above-mentioned can opener, when the operation lever 7 is pushed down to cause the cutter 16 to bite into a can lid, a force is imposed on the cutter 16, which acts so that the lower end of the cutter 16 is pushed forwardly as indicated by arrows in FIGS. 4 and 5. Also the lower end of the movable plate 13 is urged to rise up forwardly by this force. However, in the above embodiment, since a pair of legs 71 are formed on the lower end of the movable plate 13 so that they fall in contact with the back face of the regulating plate 4 disposed in the rear of the feed teeth 5, rise-up of the movable plate 13 can be completely prevented. Accordingly, the cutter 16 is caused to bite in the can lid assuredly.

Figure 10:
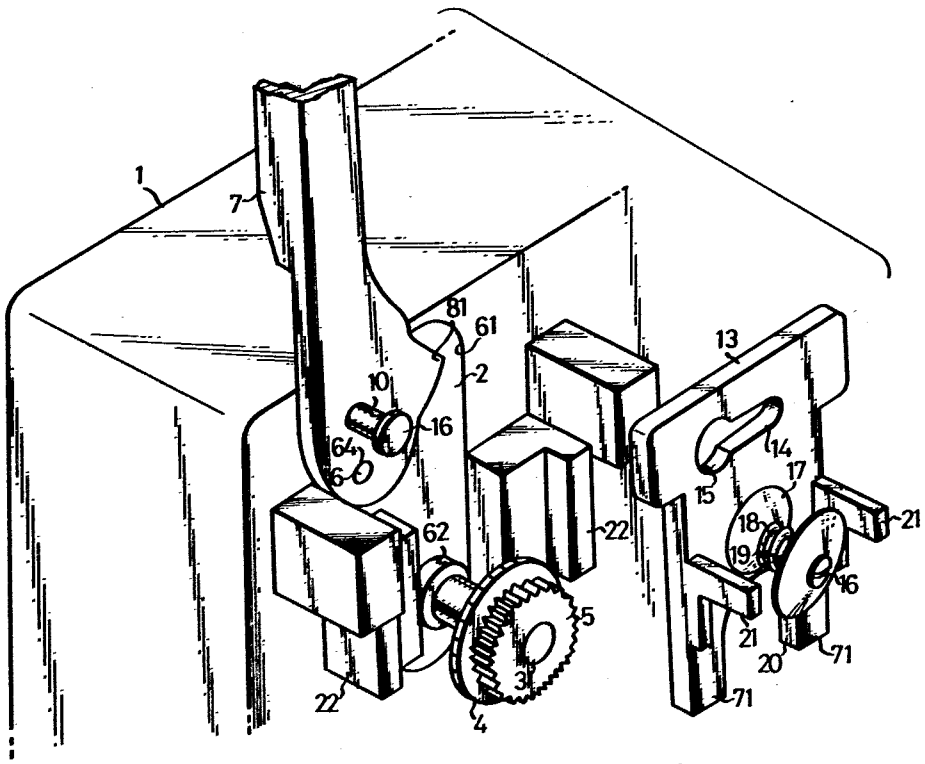
FIG. 10 is an enlarged perspective view illustrating the state where a movable plate is separated from an operation lever in a can opener according to another embodiment of the present invention.
Figure 6:
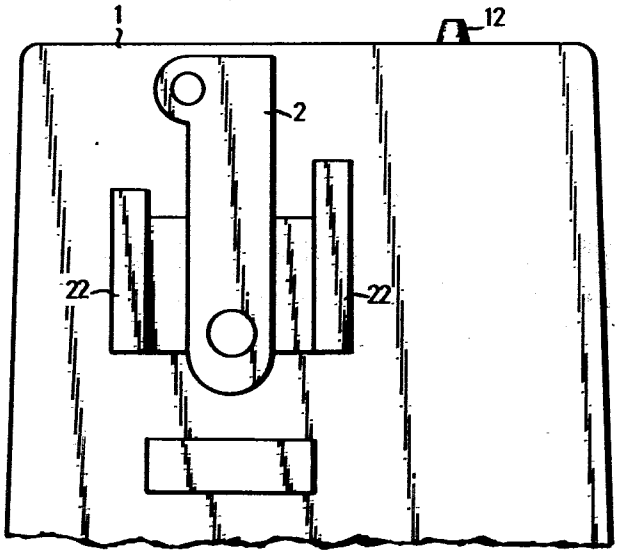
FIG. 6 is a partially enlarged view illustrating the state where a reinforcing plate is fitted in a case.
Figure 11:
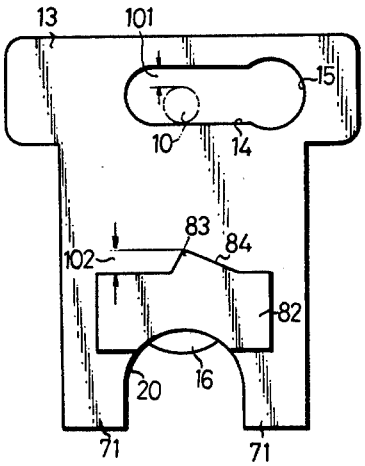
FIGS. 11 and 12 are back and side views of the movable plate shown in FIG. 10.
Figure 12:
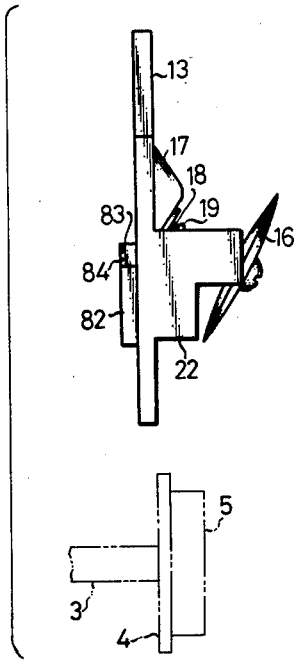

Another embodiment of the present invention will now be described by reference to FIGS. 10 to 15. In this embodiment, as shown in FIG. 11, the vertical width of the long hole 14 of the movable plate 13 is made larger by a distance 101 than the diameter of the engaging pin 10 to be inserted in this long hole 14. As shown in FIG. 10. a push-down projection 81 having a shape of a triangular plate is formed on one side of the base end portion of the operation lever 7, and as shown in FIGS. 11 and 12, an engaging member 82 is fixed to the back face of the movable plate 13. An engaging projection 83 having a triangular shape is formed in the central portion of the horizontal top face of the engaging member 82. The height 102 of this engaging projection 83 is made in agreement with the distance 101 produced when the engaging pin 10 is engaged with the long hole 14. When the cutter 16 is brought down and arrives at a position just before the position of completion of biting into the can lid, the push-down projection 81 formed on the operation lever 7 hits on and falls in contact with the skirt portion of a sliding face 84 of the engaging projection 83 of the engaging member 82. The engaging member 82 is arranged so that when the operation lever 7 is pushed down and turned, the push-down projection 81 slides on the sliding face 84 of the engaging projection 83 to push down the movable plate 13 and complete biting of the cutter 16 into the can lid. At this point of completion of biting into the can lid, the push-down projection 81 goes beyond the apex of the engaging projection 83 and is engaged with and held on an engaging face 85 of the engaging projection 83. In this embodiment, as shown in FIG. 13, an arrangement is made so that an engaging point 86 between the push-down projection 81 and the engaging projection 83 is located on the right of a line 104 connecting the shaft 6 supporting the lever 7 to a point 103 where the cutter 16 bites into the can lid.

Figure 14:
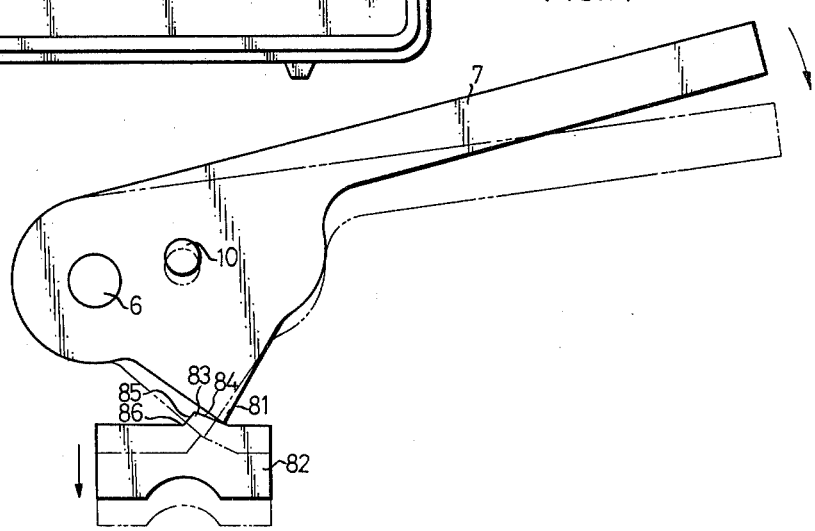

When the cutter 16 is caused to bite into the can lid by the pressing force of the operation lever 7 in the same manner as in the foregoing embodiment and the cutter 16 arrives at the point of completion of biting in the can lid, the push-down projection 81 of the lever 7 is in the state hitting on and falling in contact with the sliding face 84 of the engaging projection 83 as indicated by a solid line in FIG. 14. When the operation lever 7 is further turned in this state, the movable plate 13 is released from the pressing action of the engaging pin 10 and is pushed down by the push-down projection 81 to a position indicated by a two-dot chain line in FIG. 14. At this point, the engaging pin 10 which has been contacted with the lower face of the long hole 14 is relatively moved upwardly by the distance 101 and is located at a position where it falls in contact with the top face of the long hole 14. When the cutter 16 bites into the can lid completely, the push-down projection 81 goes beyond the apex of the engaging projection 83, and the push-down projection 81 is brought down to a position indicated by a solid line in FIG. 15 and becomes engaged with the engaging face 85. At this point, the engaging pin 10 which has been engaged with the top face of the long hole 14 is moved downwardly again by this falling movement of the push-down projection 81 and set again at the position where the engaging pin 10 hits on and fall in contact with the lower face of the long hole 14.

Simultaneously, the push-button switch 12 is depressed and put on by the turning movement of the operation lever 7 to effect the can opening operation. When the can is caused to make one rotation by means of the feed teeth 5, biting of the cutter 16 into the can lid is completed. In the foregoing can opening operation, after the operation lever 7 has been turned and pushed down, since the push-down projection 81 is engaged with the engaging surface 85 of the engaging projection 83 the operation lever 7 is maintained in the above-mentioned state and is prevented from turning upwardly. Accordingly, after the lever 7 has been pushed down, even if a hand is separated from the lever 7, the can opening operation is not stopped but automatically conducted.

On completion of the can cutting operation, no pressing force acts on the cutter 16, namely the movable plate 13, any more. Accordingly, the engagement between the push-down projection 81 and the engaging projection 83 is automatically released, and the operation lever 7 is returned to some extent and the motor 100 is automatically stopped. Also the push-button switch 12 is released from the operation lever 7 and put off to stop the motor 100, and the turning movement of the feed teeth 5 is thus stopped. Then, the can opener is ready for the subsequent can opening operation.

Figure 16:
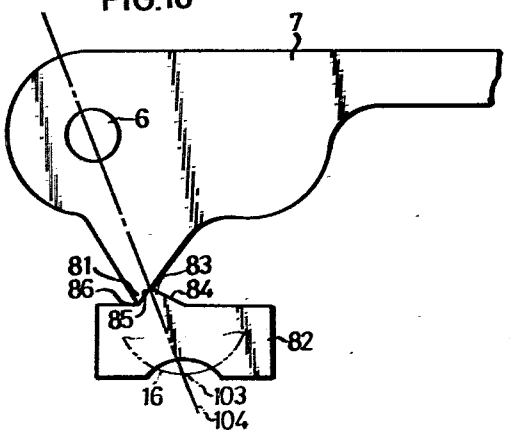
FIG. 16 is a diagram illustrating the engaging relation between a push-down projection of an operation lever and an engaging member in still another embodiment of the present invention.

In the foregoing embodiment, the engaging point 86 between the push-down projection 81 and the engaging projection 83 is located on the right of the line 104. This engaging point 86 may be located on the left of the line 104 as shown in FIG. 16. In the embodiment shown in FIG. 13, since the engaging point 86 is located on the right of the line 104, the engaging projection 83 exerts a force of pushing up the push-down projection 81 (opening the lever 7) and the push-down projection 81 is anchored only by the engaging projection 83. Accordingly, the lever 7 is kept in the unstable state, and it sometimes happens that the engagement becomes impossible because of wearing of the engaging face 85. However, if an arrangement is made so that the engaging point 86 is located on the left of the line 104 as shown in FIG. 16, the force imposed on the push-down projection 81 by the engaging member 82 acts in a direction of closing the operation lever 7. Accordingly, in this embodiment, the engaging projection 83 may be omitted. However, in this case, the movable plate 13 has a structural play to the can opener, and it sometimes happens that the push-down projection 81 and the engaging member 82 slide under shaking or the like and the moving plate 13 falls out of the can opener. In order to prevent this disadvantage, it is preferred that the engaging projection 83 be formed on the top end of the engaging member 82 also in this embodiment. While the present invention has been particularly illustrated and described in detail to some extent with reference to preferred embodiment thereof, it will be understood by those skilled in the art that various changes and modifications may be made without departing from the spirit and scope of the invention and that the present invention is not limited by specific embodiments except those specified in the appended claims.

What is claimed is:

1. A can opener, comprising:

(a) a box-like case (1) with a top end, bottom end, and a longitudinal face;

(b) a pair of guide members (22) attached to said face in the longitudinal direction thereof;

(c) a flat movable member (13) with a front face and sides, disposed in said guide members for limited longitudinal travel, said movable member including a lower end with an engaging portion and an upper end, with a linking lateral aperture (14) with an elongated narrow portion and a large diameter portion at one side thereof;

(d) an operation lever (7) with a handle portion and a pivoted end, said pivoted end being mounted on said case so that the lever can pivot between the horizontal and vertical planes;

(e) a linking engaging pin (10) disposed to cooperate with said linking lateral aperture so as to form a linking mechanism, said pin (10) being mounted towards the pivoted end of said lever (7), said pin (10) passing through said elongated lateral aperture (14), said pin having a flange preventing withdrawal from said elongated narrow portion, but allowing withdrawal through said large diameter portion;

(f) a cutter (16) rotatably attached towards the lower end of said movable member disposed to cut into a can from above;

(g) a feed gear with feed teeth (5), rotatably supported on the case (1) just below the cutter (16) and disposed so that when the cutter (16) moves downwardly, the edge of a can lid that is held there is is gripped between the cutter (16) and the feed teeth (5) and the can opening operation is performed by turning the can in this gripped state in the circumferencial direction of the can;

(h) a motor (100) disposed in the interior of the case (1) coupled so as to drive and turn the feed theeth of the feed gear (5); and, (i) a regulating member (4) disposed in the rear of the feed gear (5) and arranged so that it engages with the front face of the engaging portion of the movable member to regulate and control forward inclination of the movable member of the can opening operation.

2. A can opener as set forth in claim 1 wherein the flange of the engaging pin is formed integrally with the engaging pin.

3. A can opener as set forth in claim 1 wherein the flange of the engaging pin is a flange member formed independently from the engaging pin and screwed to the top end of the engaging pin.

4. A can opener as set forth in claim 1 wherein a pair of can pressing members are mounted on the front face of the movable member at substantially the same height as that of the cutter on both the sides of the cutter so that the can edge is pressed from above by said pressing members to support the can stably during the can opening operation.

5. A can opener as set forth in claim 1 wherein both the supporting shaft of the operation lever and the supporting shaft of the feed gear are supported by a reinforcing plate fixed to the case.

6. A can opener as set forth in claim 1 wherein the motor for driving and turning the feed teeth of the feed bear is a shading coil type single-phase induction motor, which is attached to the interior of the case through an insulating member.

7. A can opener as set forth in claim 1 wherein a single-phase winding of the motor confronting a shading coil thereof is covered with a part of the insulating member.

8. A can opener as set forth in claim 1, including rear faces on said feed teeth, a feed gear supporting shaft, the engaging portion of the movable member having a flat semi-circular aperture disposed to move astride said supporting shaft from above and said regulating member having a disc-like shape and disposed so that it comes in contact with said rear faces of said feed teath and is coaxial with the feed gear.

* * * * *